US007823286B2

(12) United States Patent
Hsu

(10) Patent No.: US 7,823,286 B2
(45) Date of Patent: Nov. 2, 2010

(54) METHOD FOR DISPOSING WICK STRUCTURE IN A HEAT PIPE BODY ASSEMBLY

(75) Inventor: Hul-Chun Hsu, Taichung (TW)

(73) Assignee: Jaffe Limited (VG)

( * ) Notice: Subject to any disclaimer, the term of this patent is extended or adjusted under 35 U.S.C. 154(b) by 940 days.

(21) Appl. No.: 11/671,735

(22) Filed: Feb. 6, 2007

(65) Prior Publication Data

US 2008/0185127 A1 Aug. 7, 2008

(51) Int. Cl.
*B21D 53/06* (2006.01)
*B23P 15/26* (2006.01)

(52) U.S. Cl. ..... 29/890.045; 165/104.26

(58) Field of Classification Search ..... 29/890.045; 165/104.26

See application file for complete search history.

(56) References Cited

U.S. PATENT DOCUMENTS 4,109,709 A * 8/1978 Honda et al. ..... 165/104.26
4,196,504 A * 4/1980 Eastman ..... 29/890.032
4,622,819 A * 11/1986 Draper et al. ..... 60/657
4,885,129 A * 12/1989 Leonard et al. ..... 419/2
6,619,384 B2 * 9/2003 Moon et al. ..... 165/104.26
7,051,794 B2 * 5/2006 Luo ..... 165/104.26
7,086,454 B1 * 8/2006 Hsu ..... 165/104.26
2002/0112334 A1 * 8/2002 Quick et al. ..... 29/419.1
2004/0111887 A1 * 6/2004 Hsu ..... 29/890.032
2006/0174478 A1 * 8/2006 Hsu ..... 29/726
2006/0177340 A1 * 8/2006 Hsu ..... 419/6
2007/0228116 A1 * 10/2007 Hsu ..... 228/244

* cited by examiner

*Primary Examiner*—Rick K Chang
(74) *Attorney, Agent, or Firm*—Chun-Ming Shih; HDLS IPR Services

(57) ABSTRACT

A wick structure of a heat pipe includes two elongated stripe-like continuous woven meshes and a plurality of fibers. A method for disposing the wick structure includes the steps of: providing a heat pipe body for accommodating the two meshes and the fibers; stacking up the two meshes so as to bundle and dispose the fibers between the two meshes; curling one end of the two meshes along a width direction, thereof; penetrating a pulling rod into an opening of one end of the heat pipe body, connecting the end of the two meshes together by means of the pulling rod, penetrating out of an opposing end of the heat pipe body so as to curl the two meshes within the heat pipe body, and the fibers being located on an axial stripe-like region within the heat pipe body; and cutting both ends of the heat pipe body.

6 Claims, 5 Drawing Sheets

METHOD FOR DISPOSING WICK STRUCTURE IN A HEAT PIPE BODY ASSEMBLY

BACKGROUND OF THE INVENTION

1. Field of the Invention

The present invention relates to a heat pipe and a method for disposing a wick structure of a heat pipe, and in particular to a wick structure within the heat pipe whereby to increase the capillary delivery in the axial direction and to a method for disposing the wick structure.

2. Description of Prior Art

A general heat pipe is provided with a wick structure on the inner wall of the pipe body. The wick structure can be formed of sintered powders, woven mesh or fibers. Alternatively, the wick structure can be formed in the drawn grooves of the inner wall during the formation of the pipe body. All of the above structures can generate a capillary action, so that the working fluid within the heat pipe can be re-flowed and delivered under the capillary action of the wick structure.

Further, in order to increase the capillary action of the wick structure within the heat pipe, or enhance the capillary action of the wick structure in a certain direction (e.g. axial or radial direction) according to various applications, the above types of wick structures may be suitably combined. However, in combining the various capillary structures, the conventional way is to combine the woven mesh with the powder, or combine the powder with grooves. Very few solutions suggest combining the better axial delivery capacity of the fibrous wick structure with other wick structures.

Therefore, in view of this, the inventor proposes the present invention to overcome the above problems based on his expert experiences and deliberate researches.

SUMMARY OF THE INVENTION

The present invention is to provide a heat pipe body assembly having a wick structure and a method for disposing the wick structure. With the wick structure made of two layers of woven meshes, a plurality of fibers can be sandwiched in an axial stripe-like region between the woven meshes. Therefore, the woven meshes abut against the fibers to provide an additional solid interface. Further, the fibers also improve the capillary delivery effect of the wick structure in the axial direction.

In order to achieve the above objects, the present invention provides a heat pipe body assembly having a wick structure, which comprises a heat pipe body having an inner wall face, and a wick structure. The wick structure is constituted of two stacked layers of woven meshes and a plurality of fibers. The two woven meshes are adhered to the inner wall face of the heat pipe body. Each fiber is sandwiched between the two woven meshes and located on an axial stripe-like region within the heat pipe body.

In order to achieve the above objects, the present invention provides a method for disposing the wick structure of the heat pipe, which comprises the steps of:

a) providing two elongated stripe-like continuous woven meshes, a plurality of fibers and a heat pipe body for accommodating the two woven meshes and the fibers;

b) stacking up the two woven meshes so as to bundle and dispose each fiber between the two woven meshes;

c) curling one end of the two woven meshes along the width direction thereof, connecting said end of the two woven meshes by means of a pulling rod;

d) penetrating the pulling rod into the opening of one end of the heat pipe body, penetrating out of the other end so as to curl the two woven meshes within the heat pipe body, and each fiber being sandwiched between the two woven meshes and located on an axial stripe-like region within the heat pipe body; and e) cutting both ends of the heat pipe body, thereby to finish disposing the wick structure of the heat pipe.

DETAILED DESCRIPTION OF THE INVENTION

In order to make the Examiner to better understand the characteristics and technical contents of the present invention, a detailed description will be made with reference to the accompanying drawings. However, it should be understood that the drawings are illustrative only but not to limit the present invention thereto.

Figure 1:
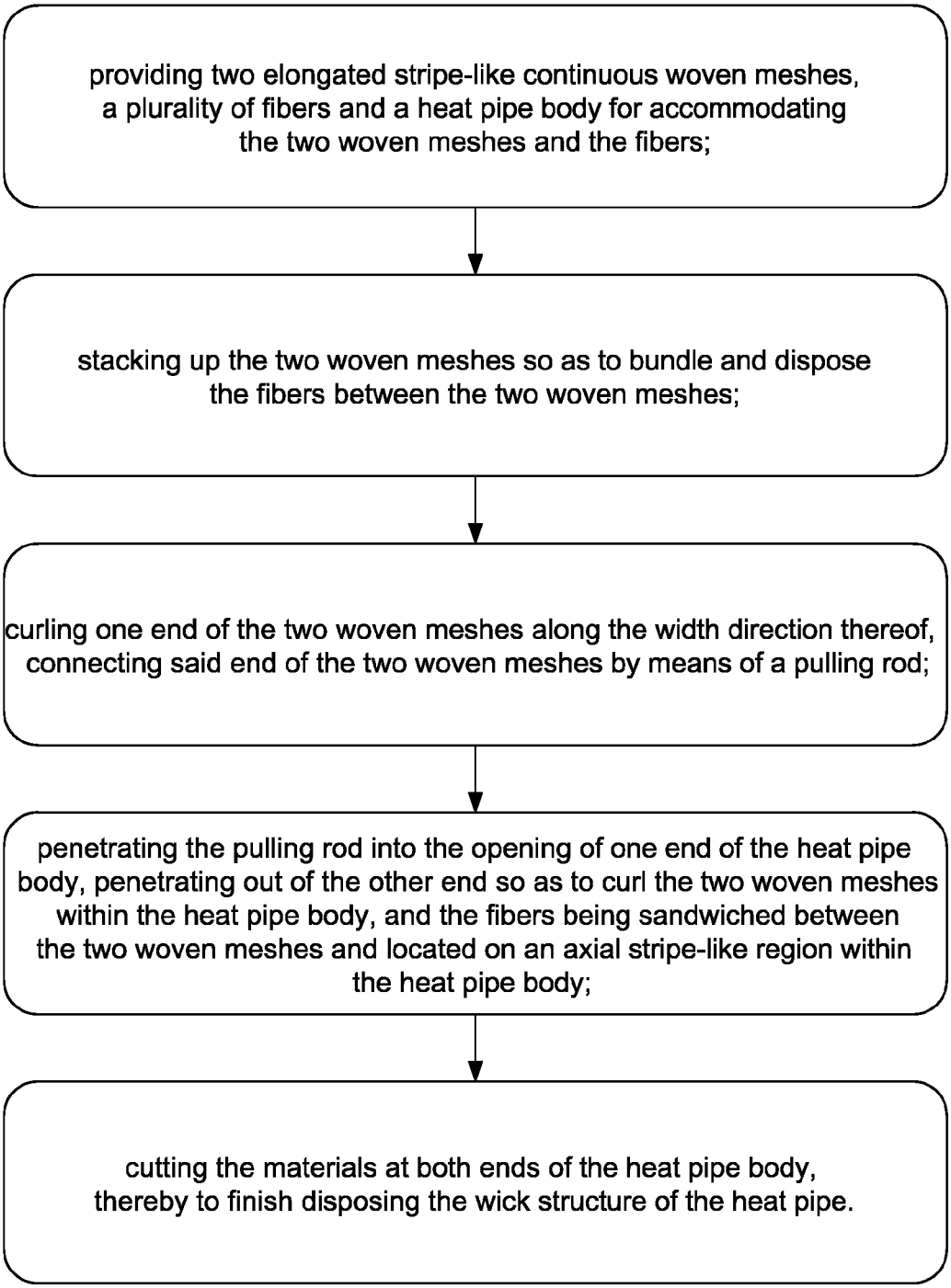
FIG. 1 is a schematic view showing the manufacturing steps of the present invention.
Figure 2:
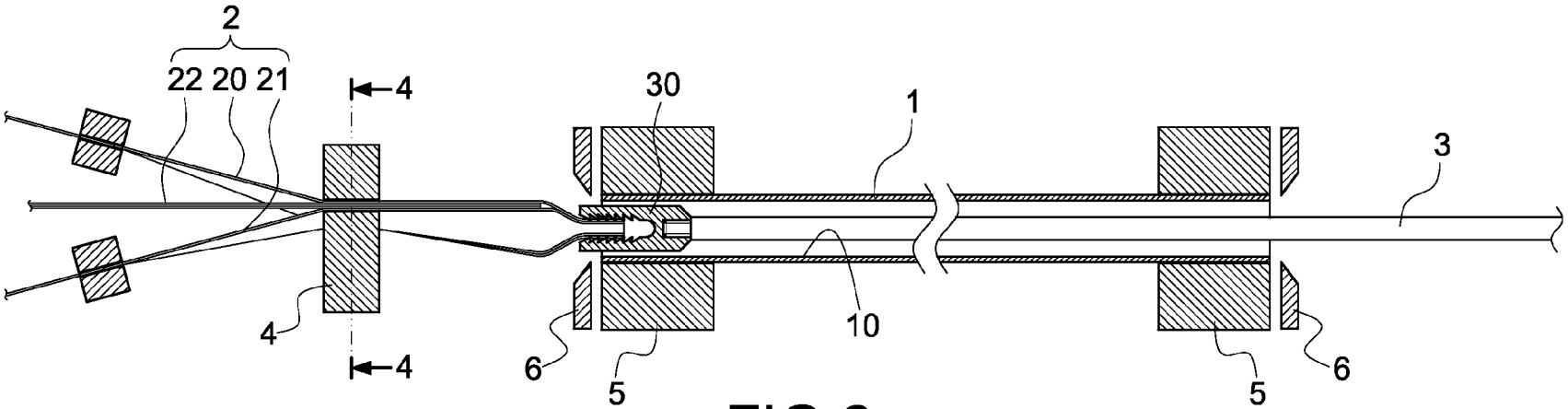
FIG. 2 is a schematic view showing the manufacturing procedure of the present invention in which the wick structure has not been disposed in the heat pipe body.
Figure 3:
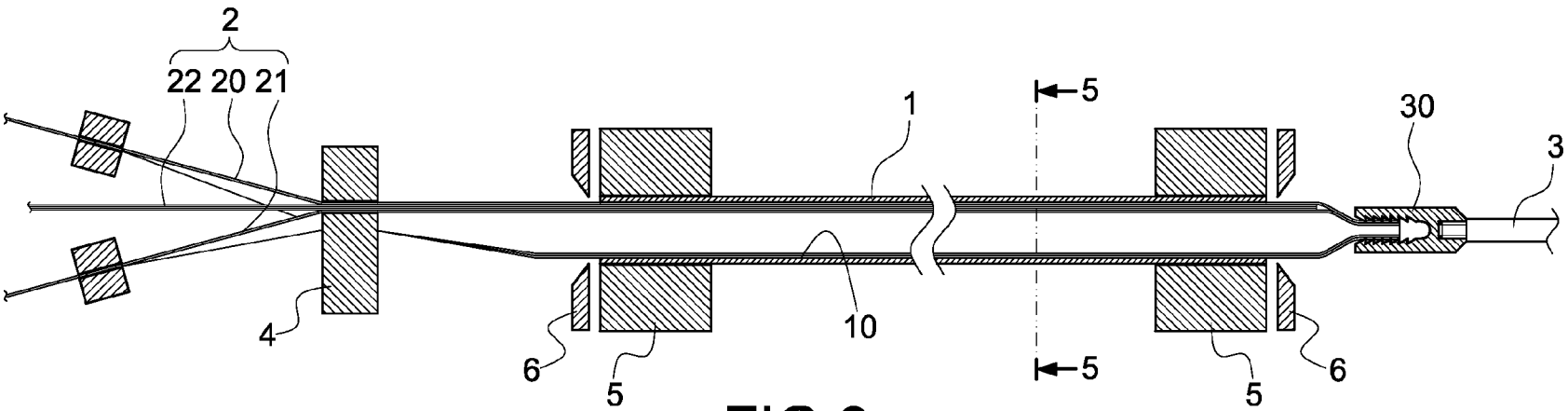
FIG. 3 is a schematic view showing the manufacturing procedure of the present invention in which the wick structure has been disposed in the heat pipe body.
Figure 4:
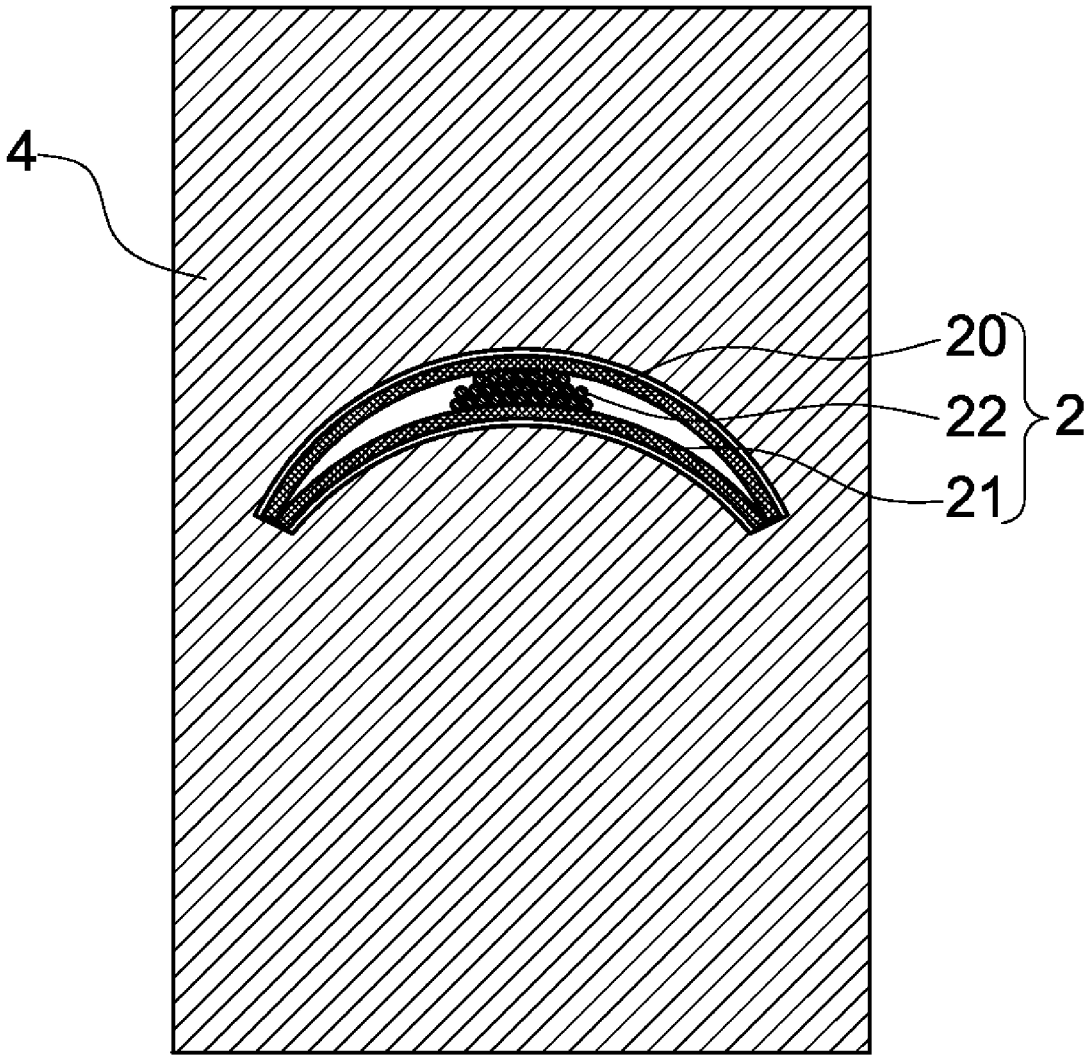
FIG. 4 is a cross-sectional view taken along the line 4-4 in FIG. 2.

FIG. 1 is a schematic view showing the manufacturing steps of the present invention. FIG. 2 is a schematic view showing the manufacturing procedure of the present invention in which the wick structure has not been disposed in the heat pipe body. FIG. 3 is a schematic view showing the manufacturing procedure of the present invention in which the wick structure has been disposed in the heat pipe body. The present invention provides a heat pipe body assembly having a wick structure and a method for disposing the wick structure. The method for disposing the wick structure comprises the following steps.

a) Two elongated stripe-like continuous woven meshes 20, 21 and a plurality of fibers 22 are provided as the wick structure 2, and a heat pipe body 1 is provided for accommodating the two woven meshes 20, 21 and the fibers 22. The heat pipe body 1 is hollow and formed with an inner wall 10 therein. During the continuous manufacture thereof the two woven meshes 20, 21 and the fibers 22 are each made into an elongated continuous stripe, and wrapped on a feeding wheel (not shown), thereby to facilitate the continuous process.

b) When the two woven meshes 20, 21 are stacked up, each fiber 22 is bundled and then disposed between the two woven meshes 20, 21. When each fiber 22 is disposed between the two woven meshes 20, 21, it can be cooperatively disposed in the length direction of the woven meshes 20, 21.

c) One end of the two woven meshes 20, 21 are curled along the width direction thereof. The end of the two woven meshes 20, 21 are fixed together by means of a pulling rod 3. The pulling rod 3 is provided with a clamping claw 30 at an end thereof connected to the two woven meshes 20, 21. The clamping claw 30 is used to clamp the two woven meshes 20, 21. In order to prevent the detachment of each fiber 22 in the subsequent steps, the same ends of each fiber 22 and the two woven meshes 20, 21 can be fixedly connected to the pulling rod 3. In this step, with one or several curling molds 4 (FIG.

4), the two woven meshes 20, 21 can be curled in one time or gradually to become a curled form smaller than that to be disposed in the heat pipe body 1. As a result, in the subsequent step, when penetrating the wick structure 2 into the heat pipe body 1, the resistance generated when the wick structure 2 enters the heat pipe body 1 can be reduced. Also, the thus-formed wick structure 2 is more smooth and flatter, thereby to increase the stability of processing.

d) The pulling rod 3 penetrates into the opening of one end of the heat pipe body 1, and then penetrates out of the other end, so that the two woven meshes 20, 21 can be disposed into the heat pipe body 1 in a curled manner. Each fiber 22 is also sandwiched between the two woven meshes 20, 21 along with the pulling rod 3 and located on an axial stripe-like region (FIG. 5) within the heat pipe body 1. Further, in this step, the heat pipe body 1 can be first fixed onto a clamping seat 5, thereby to facilitate the penetration of the pulling rod 3.

e) The materials at both ends of the heat pipe body 1 are cut by a cutting means 6 or cutting machine, thereby to finish disposing the wick structure 2 of the heat pipe.

Therefore, with the above steps, the method for disposing the wick structure of the heat pipe in accordance with the present invention can be obtained.

Figure 5:
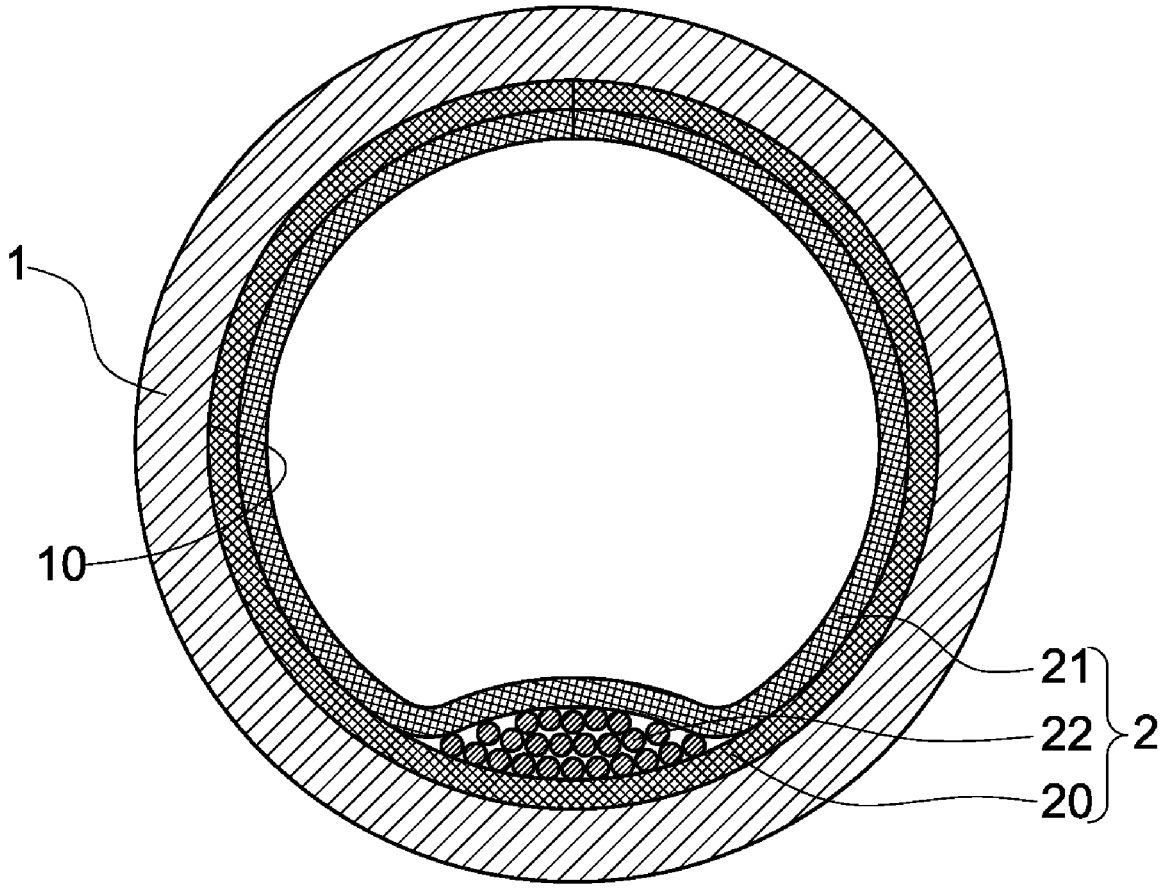
FIG. 5 is a cross-sectional view taken along the line 5-5 in FIG. 3.

According to the above, as shown in FIG. 5, the heat pipe body assembly formed based on the above steps comprises a heat pipe body 1 and a wick structure 2. The wick structure 2 is constituted of two stacked layers of woven meshes 20, 21 and a plurality of fibers 22. The woven meshes 20, 21 are adhered on the inner wall face 10 of the heat pipe body 1. The fibers 22 are sandwiched between the two woven meshes 20, 21 and located on an axial stripe-like region within the heat pipe body 1. Especially, the inner-layer woven mesh 21 can provide the necessary force for holding and adhering the fibers 22.

Therefore, when the working fluid within the heat pipe body 1 starts to change its phase, it changes from the liquid phase to the vapor phase when heated, and gradually returns to the liquid phase after cooling. As a result, the liquid-phase working liquid will be absorbed with the two woven meshes 20, 21 on the inner wall face 10 of the heat pipe body 1. However, since the axial capillary force of the fiber 22 is better, the liquid-phase working liquid can rapidly flow back to the to-be-heated end of the heat pipe body 1 through the fibers 22. The rest liquid-phase working fluid adhered to the woven meshes 20, 21 can flow to the fibers 22 along the radial direction of the heat pipe body 1. In this way, the flowing velocity of liquid-phase working fluid can be increased, thereby to improve the heat-conducting efficiency of the heat pipe.

According to the above, the present invention indeed achieves the desired effects and solves the drawbacks of prior art. Further, the present invention really has novelty and inventive steps and thus conforms to the requirements for an invention patent.

Although the present invention has been described with reference to the foregoing preferred embodiment, it will be understood that the invention is not limited to the details thereof. Various equivalent variations and modifications can still be occurred to those skilled in this art in view of the teachings of the present invention. Thus, all such variations and equivalent modifications are also embraced within the scope of the invention as defined in the appended claims.

What is claimed is:

1. A method for disposing a wick structure of a heat pipe, the wick structure comprising two elongated stripe-like continuous woven meshes and a plurality of fibers, comprising the steps of:

a) providing the two elongated stripe-like continuous woven meshes, the plurality of fibers and a heat pipe body for accommodating the two woven meshes and the fibers;

b) stacking up the two woven meshes so as to bundle and dispose the fibers between the two woven meshes;

c) curling one end of the two woven meshes along a width direction, thereof;

d) penetrating a pulling rod into an opening of one end of the heat pipe body, connecting said end of the two woven meshes together by means of the pulling rod, penetrating out of an opposing end of the heat pipe body so as to curl the two woven meshes within the heat pipe body, and the fibers being sandwiched between the two woven meshes and located on an axial stripe-like region within the heat pipe body; and e) cutting both ends of the heat pipe body, thereby to finish disposing the wick structure of the heat pipe.

2. The method according to claim 1, wherein each of the two woven meshes is wrapped on a feeding wheel in the step a), thereby to proceed a continuous processing.

3. The method according to claim 1, wherein the fibers are wrapped on a feeding wheel in the step a), thereby to proceed a continuous processing.

4. The method according to claim 1, wherein the two woven meshes are curled via a curling mold in the step c).

5. The method according to claim 1, wherein the two woven meshes are gradually curled to a curled form smaller than that within the heat pipe body in the step c).

6. The method according to claim 5, wherein the two woven meshes are made into a curled form via a plurality of curling molds.

* * * * *